US006199717B1

(12) United States Patent
Tsai

(10) Patent No.: US 6,199,717 B1
(45) Date of Patent: Mar. 13, 2001

(54) CONTAINER FOR STORING AND SUPPLYING WATER UNDER PRESSURE

(76) Inventor: Fu-Jen Tsai, 6F, No. 447, Sec. 3, Wen-Hsin Rd., Pei-Tun Dist., Taichung City (TW)

( * ) Notice: Subject to any disclaimer, the term of this patent is extended or adjusted under 35 U.S.C. 154(b) by 0 days.

(21) Appl. No.: 09/591,263

(22) Filed: Jun. 9, 2000

(51) Int. Cl.[7] ..... B67D 5/42

(52) U.S. Cl. ..... 220/723

(58) Field of Search ..... 220/723, 378, 220/359.4, 803, 804, 806

(56) References Cited

U.S. PATENT DOCUMENTS 3,158,296 * 11/1964 Cornelius ..... 220/723
4,595,037 * 6/1986 Lebreton et al. ..... 220/723
5,176,178 * 1/1993 Schurter et al. ..... 220/723
5,407,092 * 4/1995 Hardgrove et al. ..... 220/723
5,806,705 * 9/1998 Herald, Jr. et al. ..... 220/723
6,129,236 * 10/2000 Osokin et al. ..... 220/723

* cited by examiner

*Primary Examiner*—Joseph M. Moy
(74) *Attorney, Agent, or Firm*—Ladas & Parry

(57) ABSTRACT

A container for storing and supplying water includes complementary upper and lower container parts, and a water and air impermeable flexible partition member. The upper and lower container parts respectively have bottom and top rims that are bonded sealingly to each other. The bottom rim of the upper container part is formed with a lip anchoring groove therealong. The lip anchoring groove has a horizontal groove portion that extends in a radial outward direction from an inner wall surface of a surrounding wall of the upper container part, and a vertical groove portion that extends upwardly from the horizontal groove portion. The partition member is disposed in the upper container part, and has a peripheral lip that engages the bottom rim at the lip anchoring groove and that is clamped tightly between the bottom and top rims. The partition member cooperates with the upper container part to form a volume variable water chamber, and further cooperates with the lower container part to form a volume variable air chamber that is sealed off from the water chamber.

3 Claims, 7 Drawing Sheets

CONTAINER FOR STORING AND SUPPLYING WATER UNDER PRESSURE

BACKGROUND OF THE INVENTION

1. Field of the Invention

The invention relates to a water container, more particularly to a container for storing and supplying water under pressure.

2. Description of the Related Art

Referring to FIGS. 1 and 2, a conventional water container 10 is shown to comprise complementary upper and lower container parts 11, 12, a retaining ring 13 and a water and air impermeable flexible partition member 14. The upper and lower container parts 11, 12 are made of plastic. The upper container part 11 opens downwardly, and has a bottom rim 111. The lower container part 12 opens upwardly, and has a top rim 121. The upper container part 11 has a top end formed with a water inlet 112 that is adapted to be connected to a water valve (not shown). The lower container part 12 has a bottom end formed with an air inlet 122 that is adapted to be connected to an air valve (not shown). The retaining ring 13, such as an annular washer, is formed with a radial outward peripheral flange 131. The partition member 14 is disposed in the upper container part 11, and is configured to line an inner wall surface of the same. The partition member 14 is formed with a peripheral lip 141.

During assembly, the flange 131 and the lip 141 are received in an annular groove 113 that is formed in the bottom rim 111 of the upper container part 11. The upper container part 11 is then disposed on top of the lower container part 12, and the bottom and top rims 111, 121 are bonded sealingly to each other via known high frequency welding techniques such that the flange 131 and the lip 141 are clamped tightly between the rims 111, 121. At this time, the partition member 14 cooperates with the upper container part 11 to form a volume variable water chamber (A), and further cooperates with the lower container part 12 to form a volume variable air chamber (B) that is sealed off from the water chamber (A).

In use, water is introduced into the water chamber (A) via the water inlet 112. Pressurized gas is introduced into the air chamber (B) via the air inlet 122. The partition member 14 deforms due to the weight of the water in the water chamber (A), thereby compressing the gas in the air chamber (B). Thus, when water pressure at the water inlet 112 drops, the compressed gas in the air chamber (B) forces the partition member 14 upwardly so that water can be released from the water chamber (A) under pressure.

In the aforesaid conventional water container 10, the retaining ring 13 is essential to maintain tight contact among the partition member 14 and the upper and lower container parts 11, 12. Without the retaining ring 13, leakage of air and/or water can easily occur at the joint of the partition member 14 and the upper and lower container parts 11, 12. However, due to the presence of the retaining ring 13, the production cost of the conventional water container 10 is accordingly increased. Moreover, even with the presence of the retaining ring 13, it is observed that leakage of air and/or water can still occur due to the lack of a facility to ensure tight contact between the retaining ring 13 and the partition member 14. Furthermore, because the lip 141 is relatively small in size, the securing effect provided thereto is relatively weak, thereby resulting in an increased risk of air and/or water leakage.

SUMMARY OF THE INVENTION

Therefore, the object of the present invention is to provide a container for storing and supplying water under pressure which dispenses with the need for a retaining ring as taught in the aforesaid prior art and which has better protection against air and water leakage than the aforesaid prior art.

According to the present invention, a container is adapted to store and supply water, and comprises complementary upper and lower container parts, and a water and air impermeable flexible partition member.

The upper container part is formed with a water inlet, and has a top wall and a first surrounding wall with an upper end connected to the top wall, and a lower end formed with a bottom rim. The lower container part is formed with an air inlet, and has a bottom wall and a second surrounding wall with a bottom end connected to the bottom wall, and a top end formed with a top rim that is disposed below and that confronts the bottom rim. The bottom rim is formed with a lip anchoring groove therealong. The lip anchoring groove has a horizontal groove portion that confronts the top rim and that extends in a radial outward direction from an inner wall surface of the first surrounding wall, and a vertical groove portion that extends in an upward direction from one end of the horizontal groove portion distal to the inner wall surface of the first surrounding wall. The partition member is disposed in the upper container part, and has a central portion that confronts the top wall, a connecting portion that is disposed around the central portion and that is configured to line the inner wall surface of the first surrounding wall, and a peripheral lip that is disposed around the connecting portion and that engages the bottom rim at the lip anchoring groove. The peripheral lip has an upwardly extending distal portion that extends into the vertical groove portion. The bottom and top rims are bonded sealingly to each other such that the peripheral lip is clamped tightly between the bottom and top rims. The partition member cooperates with the upper container part to form a volume variable water chamber that is adapted to receive water therein, and further cooperates with the lower container part to form a volume variable air chamber that is sealed off from the water chamber and that is adapted to receive pressurized gas therein.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
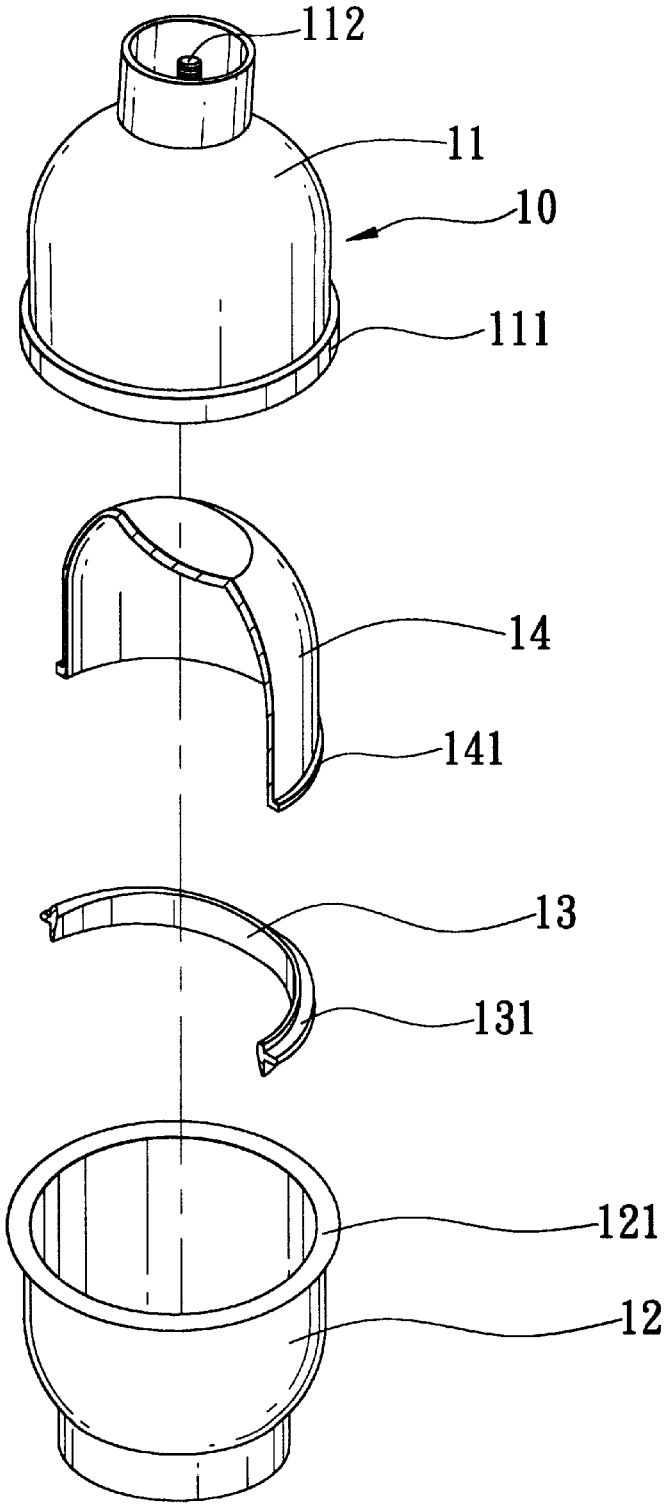
FIG. 1 PRIOR ART
FIG. 1 is an exploded view showing a conventional water container.
Figure 2:
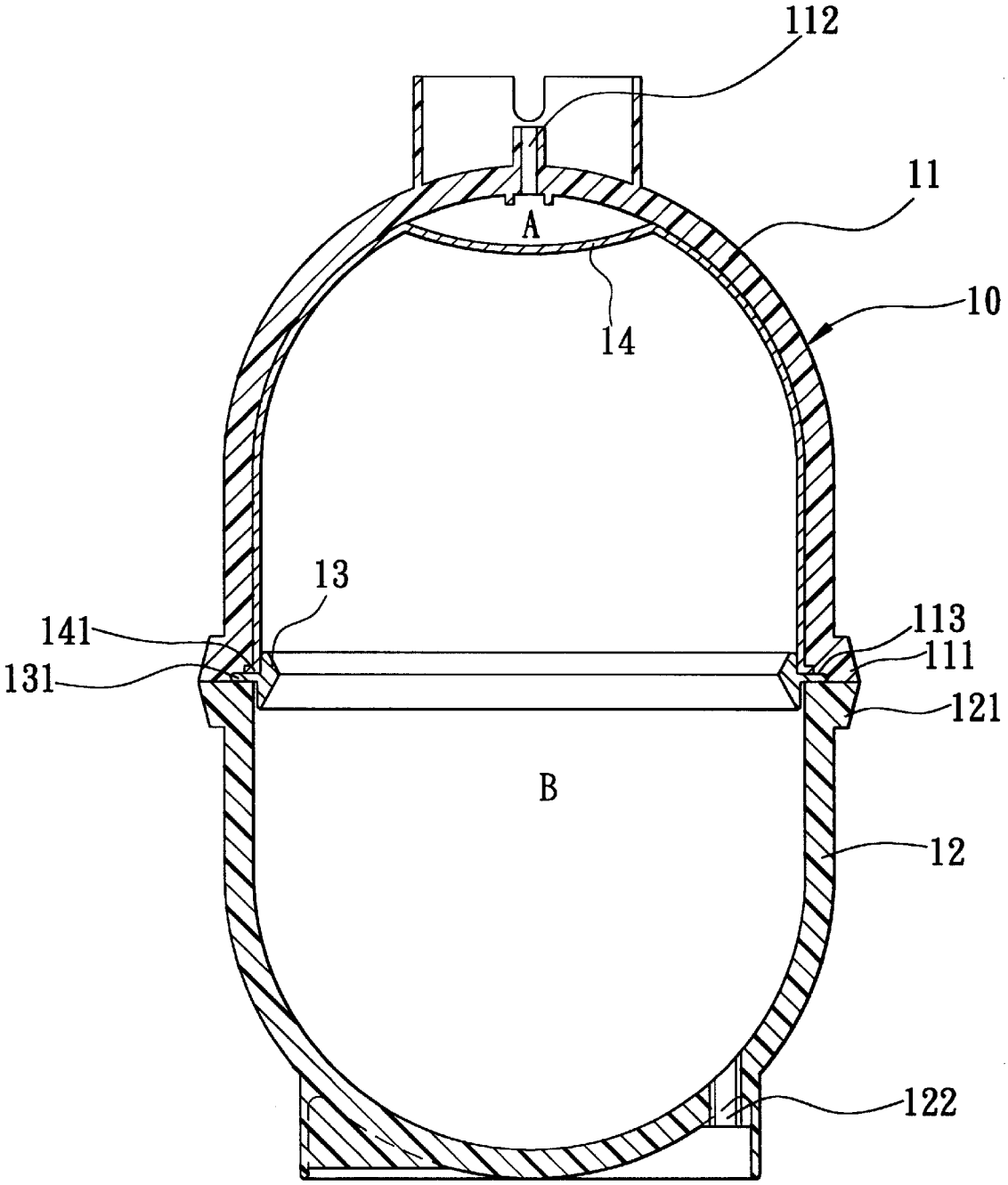
FIG. 2 PRIOR ART
FIG. 2 is a sectional view of the container of FIG. 1.
Figure 3:
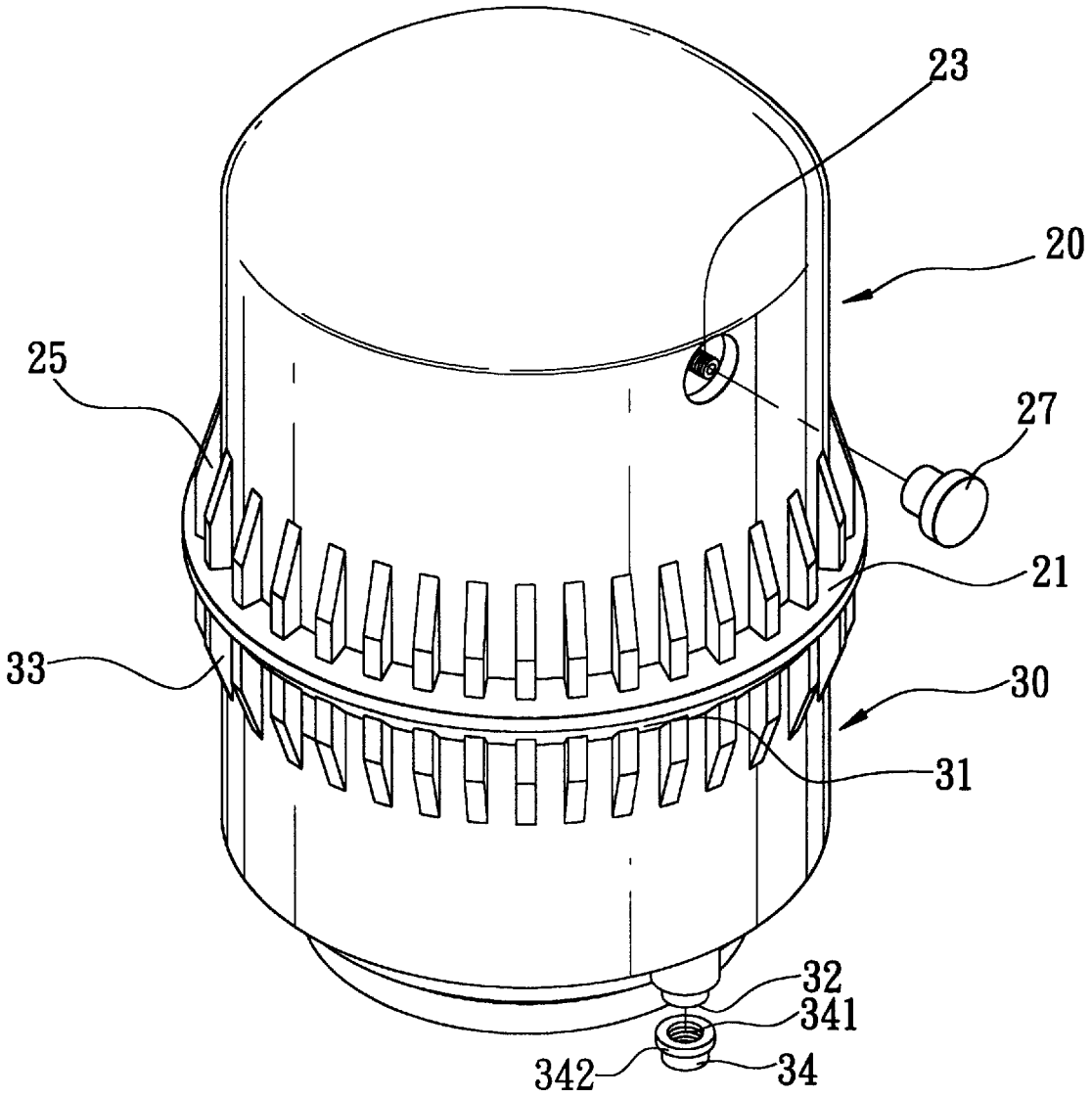
FIG. 3 is a perspective view of the preferred embodiment of a water container according to the present invention.
Figure 4:
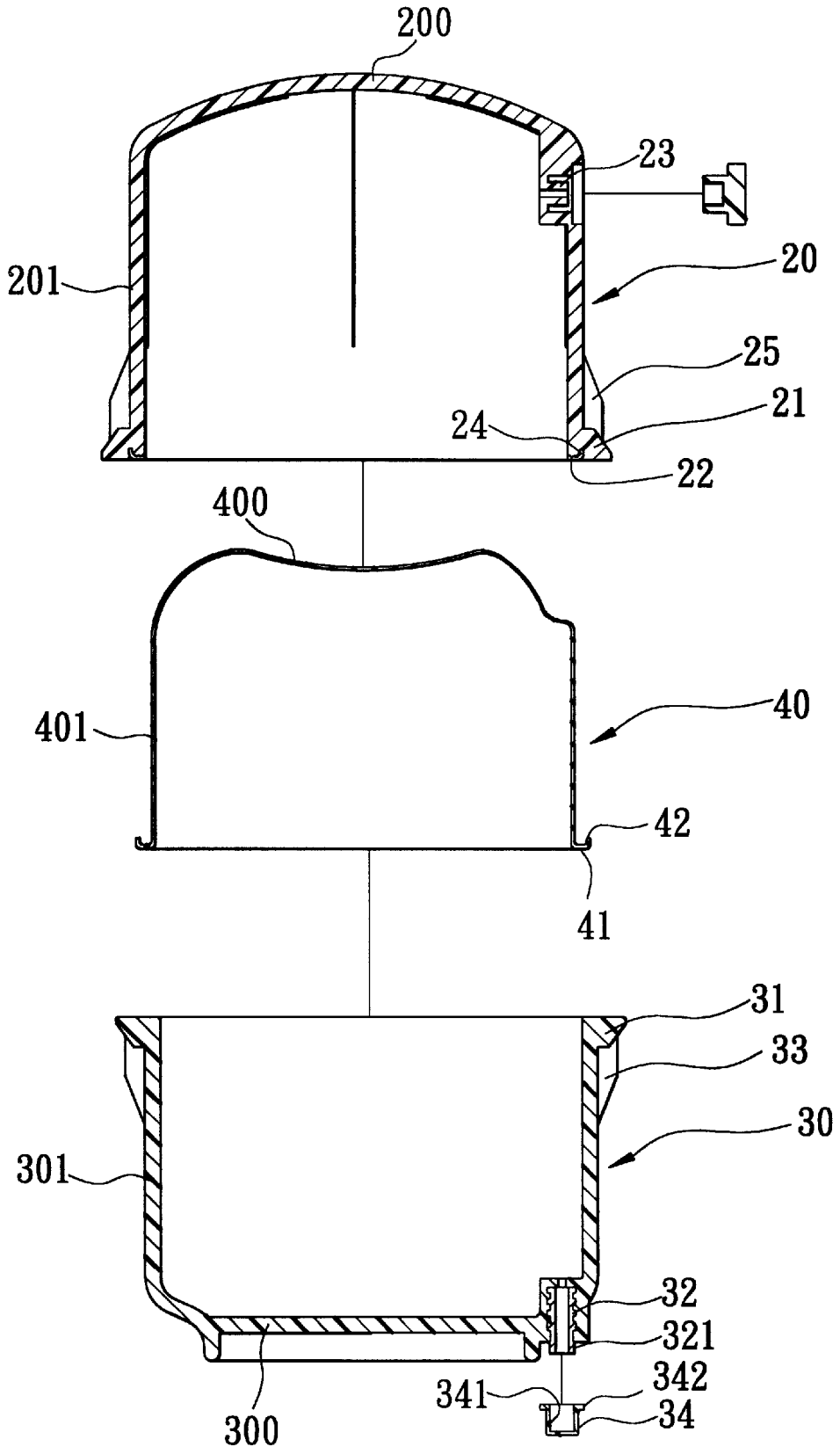
FIG. 4 is an exploded sectional view of the preferred embodiment.
Figure 5:
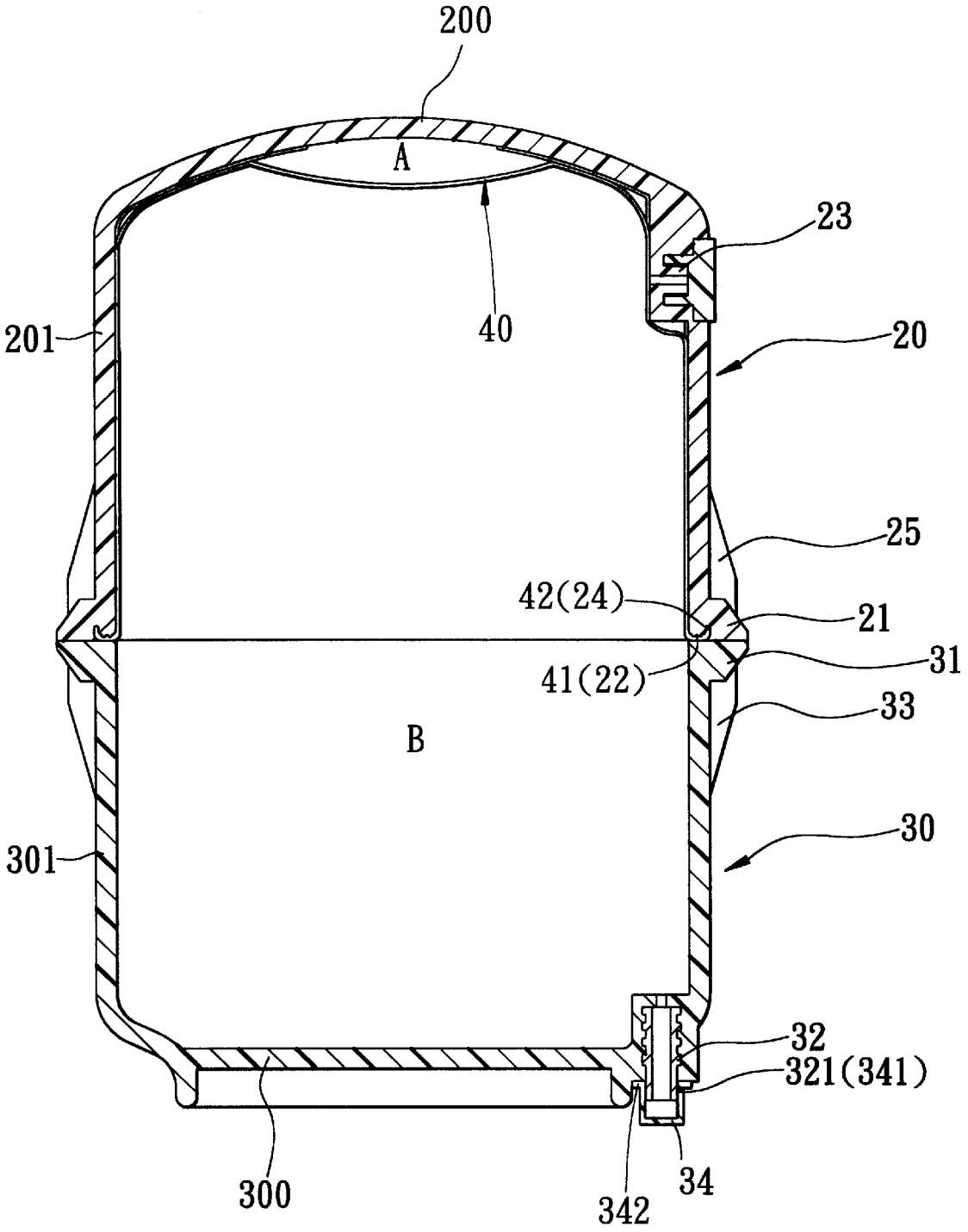
FIG. 5 is an assembled sectional view of the preferred embodiment.

Referring to FIGS. 3, 4 and 5, the preferred embodiment of a water container according to the present invention is shown to comprise complementary upper and lower container parts 20, 30, and a water and air impermeable flexible partition member 40. The upper container part 20 opens downwardly, and has a top wall 200 and a first surrounding wall 201 with an upper end connected to the top wall 200, and a lower end formed with a bottom rim 21. The lower container part 30 opens upwardly, and has a bottom wall 300 and a second surrounding wall 301 with a bottom end connected to the bottom wall 300, and a top end formed with a top rim 31. The upper container part 20 is disposed on top of the lower container part 30 such that the top rim 31 is disposed below and confronts the bottom rim 21.

The bottom rim 21 is formed with a lip anchoring groove therealong. The lip anchoring groove has an annular horizontal groove portion 22 that confronts the top rim 31 and that extends in a radial outward direction from an inner wall surface of the first surrounding wall 201, and an annular vertical groove portion 24 that extends in an upward direction from one end of the horizontal groove portion 22 distal to the inner wall surface of the first surrounding wall 201.

Figure 6:
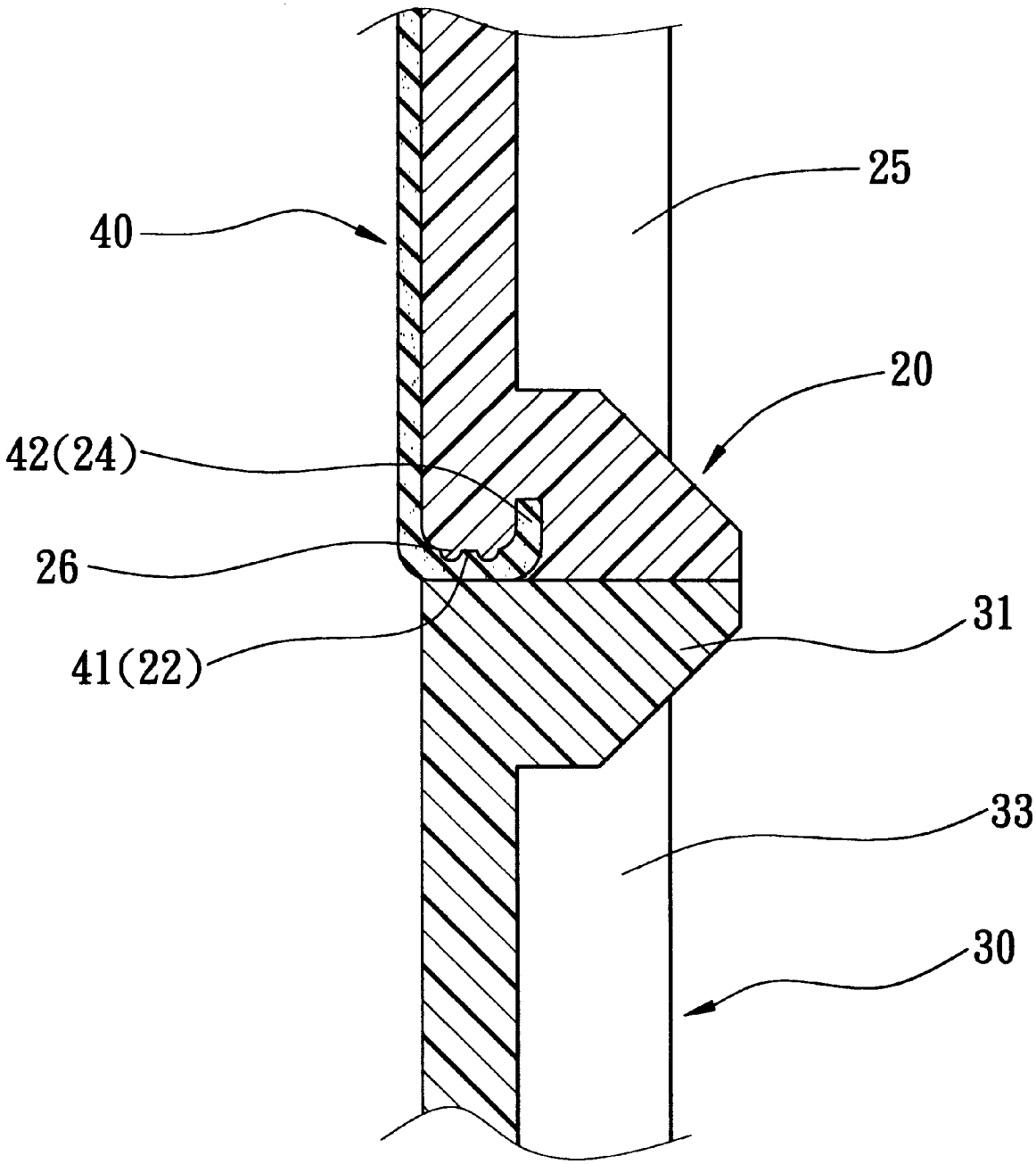
FIG. 6 is an enlarged fragmentary sectional view of the preferred embodiment.

The first surrounding wall 201 is formed with a water inlet 23 that is adapted to be connected to a water valve (not shown). A cap 27 is provided to close the water inlet 23 when the water container is not in use. The first surrounding wall 201 is further formed with a plurality of vertically extending reinforcing ribs 25 at an outer wall surface thereof. The ribs 25 are connected to the bottom rim 21 to reinforce the strength of the upper container part 20 at the bottom rim 21, which is formed with the lip anchoring groove. With reference to FIG. 6, the bottom rim 21 is further formed with a pair of retaining projections 26 that projects downwardly into the horizontal groove portion 22 of the lip anchoring groove.

Figure 7:
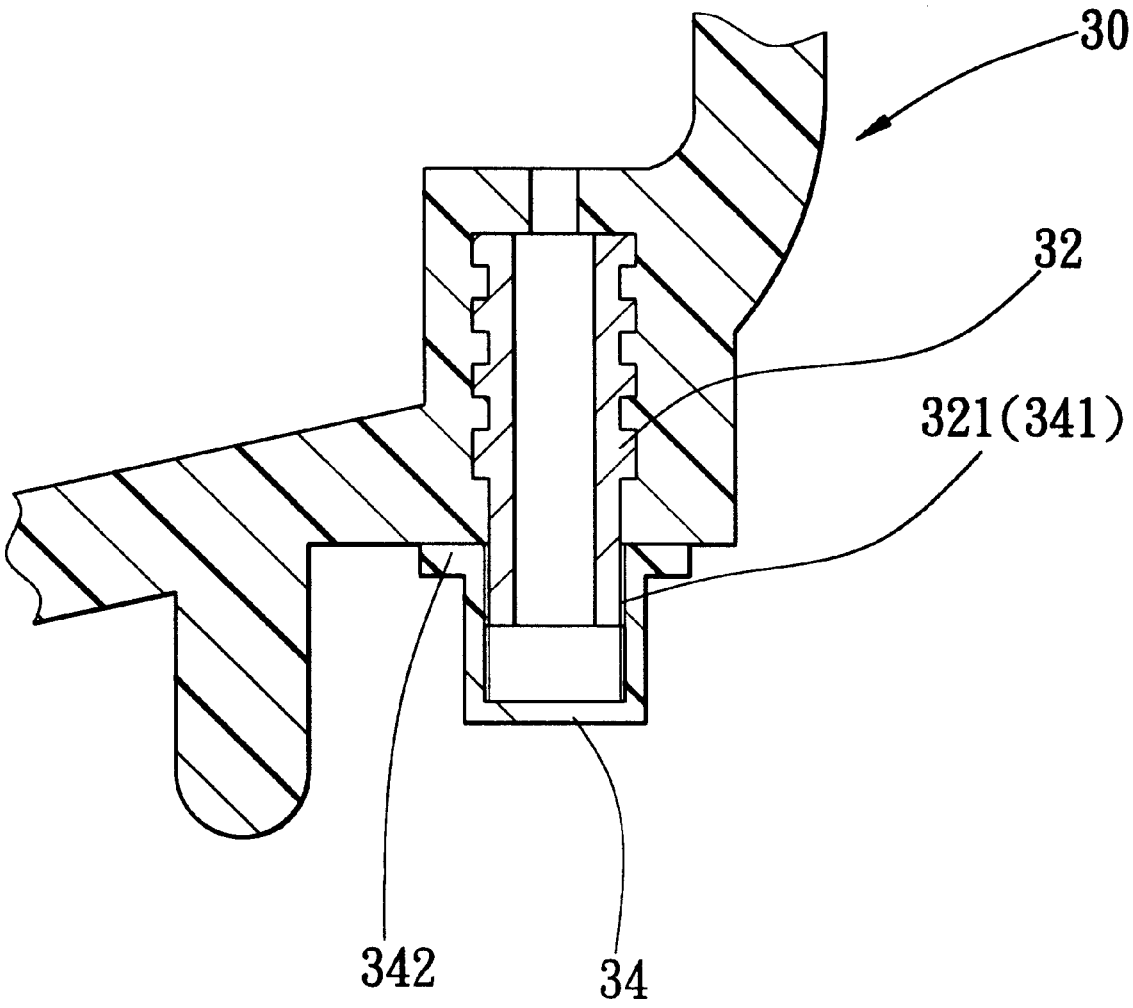
FIG. 7 is another enlarged fragmentary sectional view of the preferred embodiment.

The bottom wall 300 of the lower container part 30 is formed with an air inlet 32 that is adapted to be connected to an air valve (not shown). Like the upper container part 20, the second surrounding wall 301 of the lower container part 30 is formed with a plurality of vertically extending reinforcing ribs 33 at an outer wall surface thereof. The ribs 33 are connected to the top rim 31. As shown in FIG. 7, an externally threaded coupling pipe 321 is mounted in the air inlet 32. A cap 34 is formed with an internal screw thread 341 for threaded engagement with the coupling pipe 321. As such, the air inlet 32 can be closed with the use of the cap 34. Preferably, the cap 34 is formed with an annular skirt 342 that abuts against the lower container part 30 to guard against the entry of dust into the container.

Referring once again to FIGS. 3, 4 and 5, the partition member 40 is disposed in the upper container part 20, and has a central portion 400 that confronts the top wall 200, a connecting portion 401 that is disposed around the central portion 400 and that is configured to line the inner wall surface of the first surrounding wall 201, and a peripheral lip 41 that is disposed around the connecting portion 401. The peripheral lip 41 engages the bottom rim 21 at the lip anchoring groove, and has an upwardly extending distal portion 42 that extends fittingly into the vertical groove portion 24 of the lip anchoring groove.

During assembly, the bottom and top rims 21, 31 are bonded sealingly to each other via known high frequency welding techniques such that the retaining projections 26 press the peripheral lip 41 tightly against the top rim 31 so that the peripheral lip 41 is clamped tightly and securely between the rims 21, 31. At this time, the partition member 40 cooperates with the upper container part 20 to form a volume variable water chamber (A), and further cooperates with the lower container part 30 to form a volume variable air chamber (B) that is sealed off from the water chamber (A).

In use, water is introduced into the water chamber (A) via the water inlet 23. Pressurized gas is introduced into the air chamber (B) via the air inlet 32. The partition member 40 deforms due to the weight of the water in the water chamber (A), thereby compressing the gas in the air chamber (B). Thus, when water pressure at the water inlet 23 drops, the compressed gas in the air chamber (B) forces the partition member 40 upwardly such that water can be released from the water chamber (A) under pressure.

Due to the fitting engagement of the distal portion 42 in the vertical groove portion 24, and due to the engagement between the retaining projections 26 and the peripheral lip 41, the partition member 40 can be clamped tightly and securely between the bottom and top rims 21, 31 without the need for the retaining ring taught in the aforesaid prior art while ensuring adequate protection against air and water leakage. The object of the invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A container adapted for storing and supplying water, comprising:

complementary upper and lower container parts, said upper container part being formed with a water inlet and having a top wall and a first surrounding wall with an upper end connected to said top wall, and a lower end formed with a bottom rim, said lower container part being formed with an air inlet and having a bottom wall and a second surrounding wall with a bottom end connected to said bottom wall and a top end formed with a top rim that is disposed below and that confronts said bottom rim, said bottom rim being formed with a lip anchoring groove therealong, said lip anchoring groove having a horizontal groove portion that confronts said top rim and that extends in a radial outward direction from an inner wall surface of said first surrounding wall, and a vertical groove portion that extends in an upward direction from one end of said horizontal groove portion distal to said inner wall surface of said first surrounding wall; and a water and air impermeable flexible partition member disposed in said upper container part and having a central portion that confronts said top wall, a connecting portion that is disposed around said central portion and that is configured to line said inner wall surface of said first surrounding wall, and a peripheral lip that is disposed around said connecting portion and that engages said bottom rim at said lip anchoring groove, said peripheral lip having an upwardly extending distal portion that extends into said vertical groove portion;

said bottom and top rims being bonded sealingly to each other such that said peripheral lip is clamped tightly between said bottom and top rims;

said partition member cooperating with said upper container part to form a volume variable water chamber that is adapted to receive water therein, and further cooperating with said lower container part to form a volume variable air chamber that is sealed off from said water chamber and that is adapted to receive pressurized gas therein.

2. The container of claim 1, wherein at least one of said first and second surrounding walls has an outer wall surface that is formed with a plurality of vertically extending reinforcing ribs connected to a respective one of said bottom and top rims.

3. The container of claim 1, wherein said bottom rim is further formed with at least one retaining projection that projects downwardly into said horizontal groove portion and that presses said peripheral lip tightly against said top rim.

* * * * *